United States Patent [19]

Waddell et al.

[11] 4,214,536

[45] Jul. 29, 1980

[54] HOPPER OUTLET HAVING VERTICALLY MOVABLE DOOR BEARING

[75] Inventors: Jerry D. Waddell, O'Fallon; John J. Scheeter; David A. Stoller, both of St. Charles, all of Mo.

[73] Assignee: ACF Industries, Incorporated, New York, N.Y.

[21] Appl. No.: 845,603

[22] Filed: Oct. 26, 1977

[51] Int. Cl.[2] ..... B61D 7/20; B61D 7/22; B61D 7/26

[52] U.S. Cl. ..... 105/282 P; 105/282 A; 105/305; 105/424

[58] Field of Search ..... 105/282 A, 282 P, 282 R, 105/424, 305

[56] References Cited

U.S. PATENT DOCUMENTS

| | | | |
|---|---|---|---|
| 743,504 | 11/1903 | Hart | 105/424 X |
| 1,014,768 | 1/1912 | Meissner | 105/424 X |
| 2,738,735 | 3/1956 | Zimmer | 105/282 R |
| 2,738,739 | 3/1956 | Dorey | 105/282 P |
| 3,138,116 | 6/1964 | Dorey | 105/282 P X |
| 3,255,714 | 6/1966 | Dorey | 105/424 X |
| 3,495,549 | 2/1970 | Dorey | 105/305 X |
| 3,626,866 | 12/1971 | Fritz | 105/282 R |
| 3,631,813 | 1/1972 | Dorey | 105/282 P |
| 3,807,318 | 4/1974 | Chierici | 105/282 A |
| 3,877,392 | 4/1975 | Akester et al. | 105/282 P |

*Primary Examiner*—Howard Beltran

*Attorney, Agent, or Firm*—Henry W. Cummings

[57] ABSTRACT

In accordance with the present invention a hopper outlet is provided including transversely spaced, fixed racks on opposite sides of the outlet which extend longitudinally away from the outlet. At least one door bearing is attached to the outer end of a generally horizontally moving outlet gate. A ramp including an inclined cam surface is located below the inner outlet end wall. U-shaped elastomeric seals extend below the outlet sides and end walls and the lower leg of the seal engages the gate. A transversely extending pinion shaft includes pinions which ride upon the racks in moving between open and closed position. The pinion shaft extends through a slot in the door bearing. The slot is elongated vertically to allow vertical movement of the gate and the door bearing relative to the pinion shaft as the gate is ramped upwardly into closed position and downwardly into open position.

6 Claims, 11 Drawing Figures

HOPPER OUTLET HAVING VERTICALLY MOVABLE DOOR BEARING

BACKGROUND OF THE INVENTION

In U.S. Pat. No. 3,877,392, assigned to the same assignee as the present application, an elastomeric seal member is attached to the lower inner ends of the outlet walls including a tail portion extending along the external surface of the outlet wall, and a depending head portion which is engaged by the gate in closed position and when the gate moves between open and closed position. The engagement of the seal with the gate provides frictional resistance to movement of the gate. This force is sufficient to wear out the head portion of the seal, and added opening and closing torque is required to overcome it. Furthermore, air and entrained lading can escape by displacing the head portion outwardly as shown in FIG. 2. Also lading can collect upon longitudinally extending supports for the gate as shown in FIG. 3 and below the closure lip for the gate as shown in FIG. 4. Thus the gate does not assume the properly closed position, as illustrated in FIGS. 3 and 4.

In U.S. Pat. No. 3,626,866 a hopper outlet is disclosed in which U shaped resilient metallic sealing strips are attached to the external surface of the lower inner ends of inclined outlet walls with one leg of the U shaped member attached to the hopper wall and the other leg engaged by an outlet gate in closed position. These metallic seals are disadvantageous because they are easily damaged and require special equipment to install new units. They are expensive and require a specially formed gate.

In U.S. Pat. No. 2,738,735 a gravity outlet gate is ramped into closed position by an inclined cam surface located below the inner edge of the inner outlet wall. The gate includes a slot located below the front outlet wall which allows the gate to be ramped upwardly into closed position by the inclined cam surface without abutting the support for the front outlet wall.

SUMMARY OF THE INVENTION

In accordance with the present invention a hopper outlet is provided including transversely spaced, fixed racks located on opposite sides of the outlet which extend longitudinally away from the outlet. At least one door bearing is attached to the outer end of a generally horizontally moving outlet gate. A ramp including an inclined cam surface is located below the inner outlet end wall. A transversely extending pinion shaft includes pinions which ride upon the racks in moving between open and closed position. The pinion shaft extends through a slot in the door bearing. The slot is elongated vertically to allow vertical movement of the door bearing relative to the pinion shaft as the gate is ramped upwardly into closed position and downwardly into open position. U-shaped elastomeric seals extend below the outlet sides and outer end wall and the lower leg of the seal engages the gate. Preferably a similar elastomeric seal located in the inner end wall engages the gate in closed position. In moving between open and closed positions the gate engages one leg of the elastomeric U-shaped sealing members located on the sides and outer wall with a limited amount of fricitional resistance to movement of the gate. The inwardly directed lower leg of outer end seal results in an effective seal which prevents escape of air and lading during loading or unloading of the lading. The inward and downward inclination of the lower leg of the side seal members prevent a build up of lading on the side supports of the outlet. The inclined portion of the ramp on the gate cams the gate into closed position and reduces the tendency for lading to build up below the inner hopper wall and prevent the gate from assuming the properly closed position.

THE DRAWINGS

FIG. 1 is a longitudinal sectional view through a gravity outlet constructed generally according to the teachings of U.S. Pat. No. 3,877,392 showing the prior art;

DESCRIPTION OF THE PRIOR ART

Figure 2:
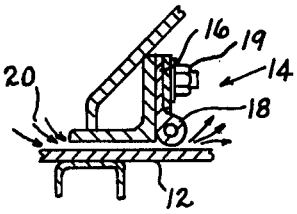
FIG. 2. PRIOR ART
FIG. 2 is an enlarged view of the front portion of the outlet shown within the area 2—2 in FIG. 1 illustrating air and lading escaping from the outlet.
Figure 1:
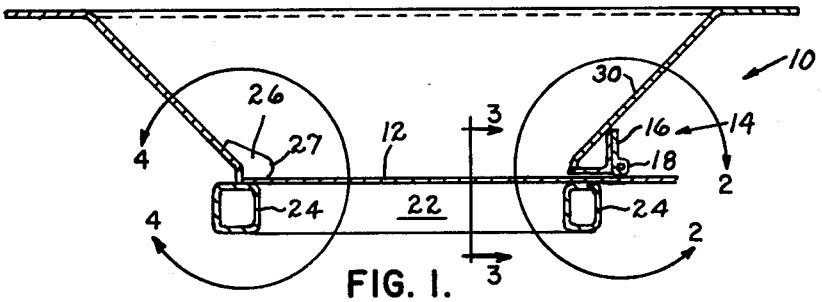
FIG. 1. PRIOR ART

In a prior art gravity outlet described in U.S. Pat. No. 3,877,392 and indicated at 10 in FIG. 1, a gravity gate 12 engages a seal member 14 including a stem or tail 16 and a head 18 held in place with fasteners 19 (FIG. 2). When the gate moves between open and closed position, the seal head 18 engaging gate 12 provides a frictional force acting in a direction opposite the direction of movement of the gate which tends to result in rapid wear of the head portion 18, and increases the torque necessary to open and close the outlet. This frictional force reduces the tendency for the gate to close automatically if the gate is inadvertently left open by the operator, and the car is impacted while in transit or in a railyard.

Furthermore, as shown in FIG. 2, during loading and unloading of the outlet, air and lading indicated by the arrows 20 displace the head portion 18 outwardly to an extent sufficient that air and lading can escape.

Figure 3:
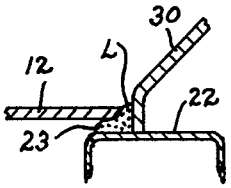
FIG. 3. PRIOR ART
FIG. 3 is a view looking in the direction of the arrows along the line 3—3 in FIG. 1 illustrating lading located above a longitudinal support for the gate, moving the gate out of position.
Figure 4:
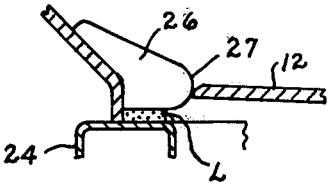
FIG. 4. PRIOR ART
FIG. 4 is an enlarged view of the rear portion of the gate within the area 4—4 in FIG. 1 illustrating lading below the rear cam guide preventing the gate from assuming a properly closed position.

In U.S. Pat. No. 3,877,392 the sides of the outlet are supported on rectangular tubes 22 and 24. However as shown in FIG. 3, lading L can build up upon the rectangular tubes 22 and 24 between the end of the gate 12 and the side wall 30, raising the gate above the upper surface 33 of the tubes. An inclined closure lug 26 having a front cam surface 27 is used to guide the gate 12 into closed position. As shown in FIG. 4, lading L may accumulate below the closure lug 26. Thus the gate does not assume the properly closed position, as illustrated in FIGS. 3 and 4.

DESCRIPTION OF PREFERRED EMBODIMENTS

Figure 7:
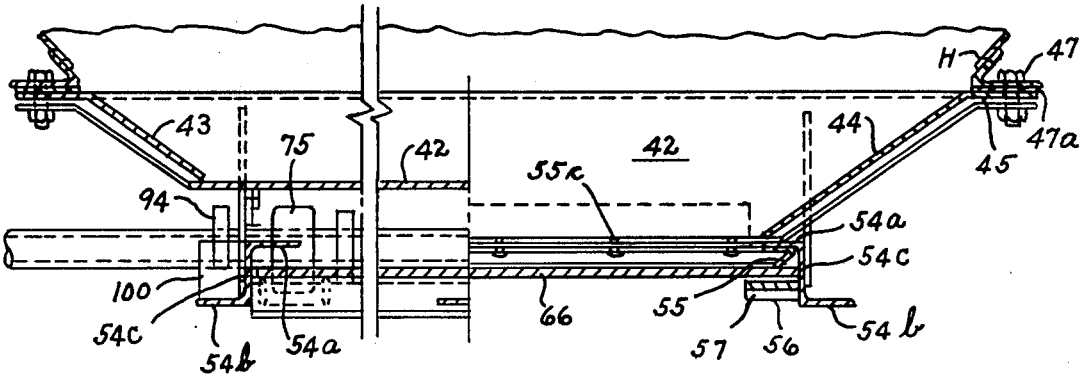
FIG. 7 is a transverse sectional view through the outlet shown in FIG. 5 looking in the direction of the arrows along the line 7—7 in FIG. 5.
Figure 5:
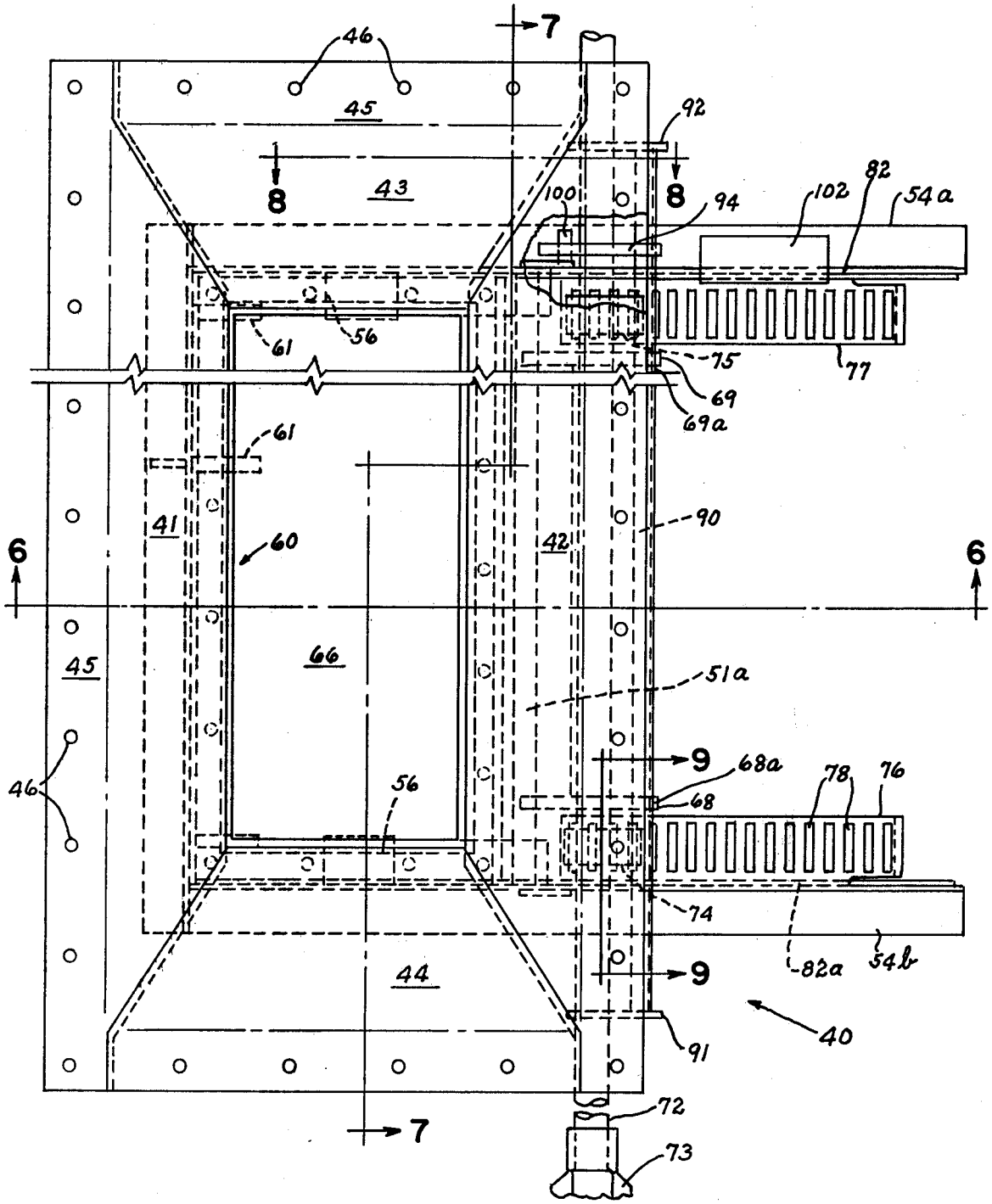
FIG. 5 is a plan view of the gravity outlet of the present invention with a portion cut off.
Figure 6:
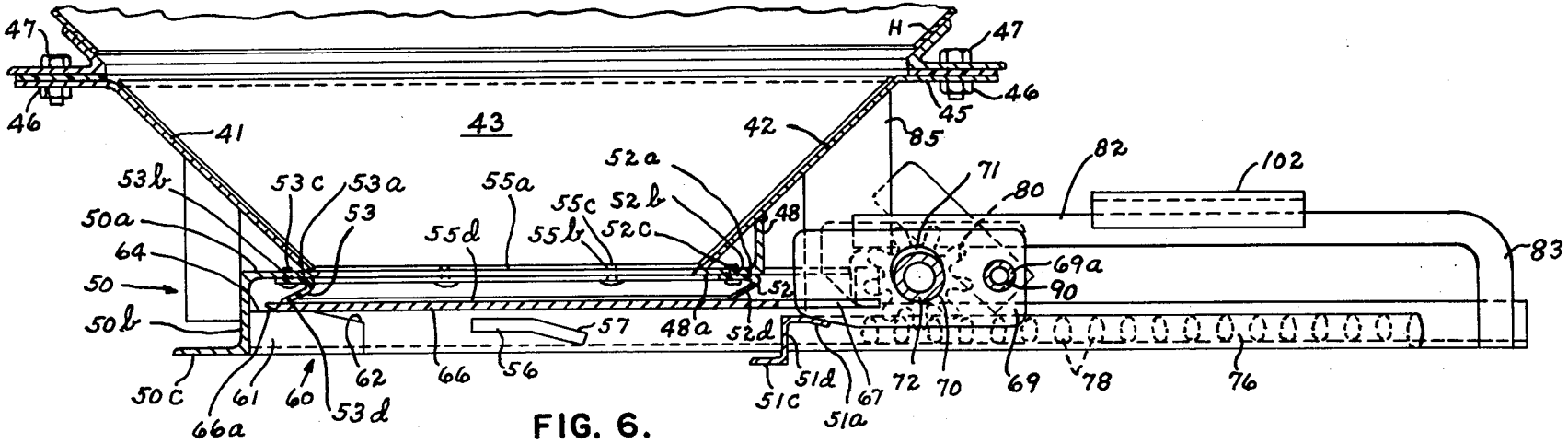
FIG. 6 is a longitudinal sectional view of the outlet shown in FIG. 5 looking in the direction of the arrows along the line 6—6 in FIG. 5.

In accordance with the present invention the foregoing problems are reduced or eliminated with the outlet indicated in FIG. 5 at 40. This outlet includes an inner end wall 41 and an outer end wall 42 and transversely spaced side walls 43 and 44. Each of the side and end walls include flange portions 45 having openings therein 46 to receive fasteners 47 to mount the outlet upon a hopper H as shown in FIGS. 6 and 7. A seal 47*a* is also provided. An angle 48 (FIG. 6) is welded to the lower portion of outer wall 42. A Z shaped member 50 is welded to inner wall 41 having upper and lower horizontal legs 50*a* and 50*c* supported by a vertical web portion 50*b*. Seal member 52 is attached to the lower surface of angle 48 and seal member 53 is attached to the lower surface of the upper leg 50*a* of Z shaped member 50.

As shown in FIG. 7, Z shaped members 54 are attached to side walls 43 and 44. Z members 54 also include upper and lower horizontal legs 54*a* and 54*b* separated by vertical web 54*c*. Seal members 55 are attached to the lower surface of upper legs 54*a*. Ledges 56 are attached on opposite sides to vertical web portions 54*c* below the inner edges 43*a* and 44*a* of side walls 43 and 44, and they are both out of lading flow. Ledges 56 are provided to support the gate and include an outer inclined surface 57 (FIG. 6).

Below the inner wall 41, ramp 60 is provided. Ramp 60 includes a plurality of blocks 61 welded to Z member 50, having an inclined cam surface 62 and a horizontal surface 64 upon which gate 66 rests in closed position. Gate 66 includes a front portion 66*a* and an outer portion 67 to which is attachd a pair of door bearings 68 and 69 (FIG. 5). Door bearings 68 and 69 engage transverse Z shaped members 51 (FIG. 6) in closed position including inclined portion 51*a*, web 51*b* and horizontal portion 51*c*. Each door bearing includes an opening or slot 70 through which a pinion shaft 72 passes extending transversely of the outlet. Slots 70 are elongated in the vertical direction as indicated at 71 to allow the door bearings to move vertically relative to the pinion shaft 72 as the gate moves up and down ramp inclined portion 62 in moving between open and closed positions.

Figure 9:
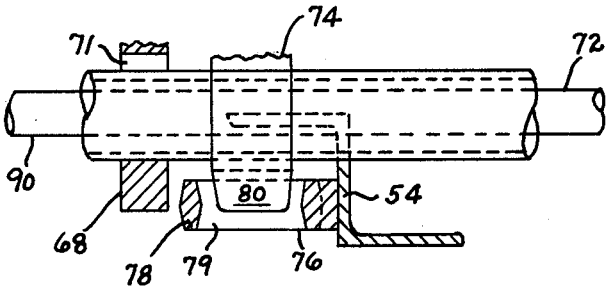
FIG. 9 is a partial transverse sectional view looking in the direction of the arrows along the line 9—9 in FIG. 5.

The pinion shaft 72 has a capstan 73 and pinions 74 and 75 attached thereto at opposite sides of the outlet. Below the end wall 42 racks 76 and 77 are attached to Z shaped members 54 on either side of the outlet. Racks 76 and 77 include rack teeth 78 and openings 79 (FIG. 9) into which pinion teeth 80 from pinion 74 extend in moving the gate 66 longitudinally of the outlet between open and closed positions. Pinion shaft guides 82 and 82*a* (FIGS. 5 and 6) each include rear depending legs 83 which are welded to racks 76 and 77 and Z shaped supports 54. The front portions 84 are welded to brackets 85 (FIG. 8) which depend from and are welded to respective side walls 43 and 44.

A locking shaft 90 extends transversely of the outlet through openings 68*a* and 69*a* respectively in door bearings 68 and 69. Locking handles 91 and 92 are provided at opposite ends of the locking shaft. On the side of the outlet adjacent door bearing 69, a locking member 94 is attached to locking shaft 92. Locking member 94 includes a slot 96 (FIG. 8) through which pinion shaft 72 passes, and a nose 97 having an inclined cam portion 98. A locking lug 100 is welded to Z support portions 54*b* and 54*c*. A tripping lug 102 is welded to pinion shaft guide 82. Locking member 94 operates basically in the same manner as locking member 58 as described in U.S. Pat. No. 3,877,392, hereby incorporated into the present application by this reference.

Seal members 52, 53, and 55 are constructed in the same manner. Each seal member includes a first leg 52*a*, 53*a*, 55*a*, which is attached to the lower surface of a support 48, 50, 54. Openings 52*b*, 53*b*, 55*b* are provided through which fasteners 52*c*, 53*c*, 55*c* pass to hold each seal in place. Each seal includes a depending leg 52*d*, 53*d*, 55*d* which engages the gate. The depending legs 52*d* and 55*d* extend downwardly and inwardly to direct lading downwardly and inwardly to prevent lading build up of the type shown in FIG. 3. While leg 53*d* extends downwardly and outwardly, ramp surface 62 extends downwardly and inwardly. Thus lading build up similar to that shown in FIG. 4 is reduced or avoided with the seal and ramp arrangement of the invention.

When the legs 52*d* and 55*d* engage the gate, air and lading pressure urges the legs into more firm engagement with the gate, creating a U cup type seal on three (3) sides which reacts against lading pressure. Thus the problem of air and lading escaping as illustrated in FIG. 2 is reduced or avoided.

Figure 11:
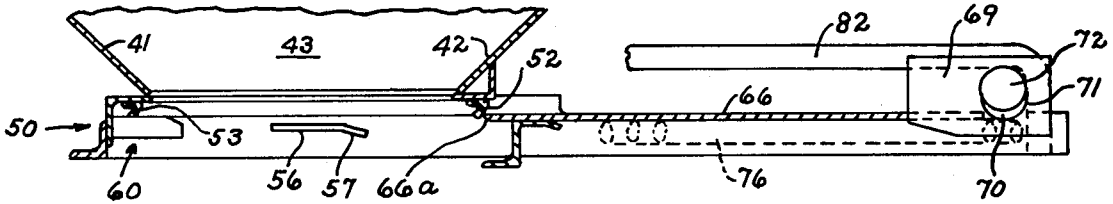
FIG. 11 is a schematic longitudinal sectional view similar to FIG. 10 illustrating the gate in the full open position with the door bearing engaging a stop on the pinion shaft guide.
Figure 10:
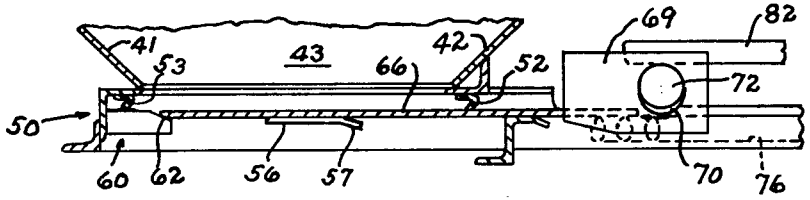
FIG. 10 is a schematic longitudinal sectional view illustrating the gate and door bearing in a partially open position with the pinion shaft located at the upper portion of the door bearing slot.
Figure 8:
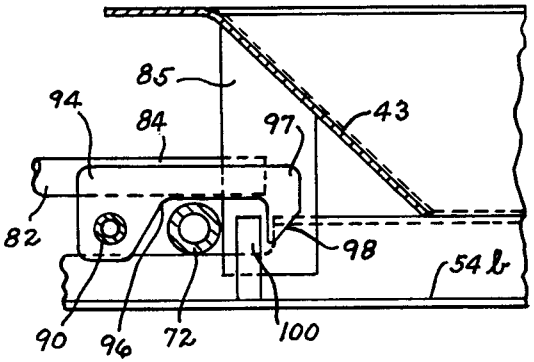
FIG. 8 is a partial longitudinal sectional view looking in the direction of the arrows along the line 8—8 in FIG. 5 illustrating an automatic locking member.

In operation, the outlet arrives at the unloading site with the gate 66 in the position shown in FIGS. 5, 6 and 8. One of the handles 91 or 92 is used to move locking member 94 out of engagement with locking lug 100 and resting against tripping lug 102. An operating bar (not shown) is inserted into capstan 73 and pinion shaft 72 is rotated to move gate 66 and pinion shaft 72 from left to right in FIGS. 5 and 6 along racks 76 and 77. Gate 66 first moves a short distance horizontally along horizontal ramp surface 64, and then downwardly along inclined ramp surface 62 to the position shown in FIG. 10 with the gate 66 supported by ledge 56 and inclined ramp surface 62. The door bearings 68 and 69 have also moved downwardly relative to pinion shaft 72 by virtue of the elongated slots 70 provided in each door bearing. Furthermore once the gate begins descending ramp surface 62 in moving toward open position, the torque required to open the gate is reduced. Further left to right movement of the gate causes locking member 94 to be tripped by tripping lug 102 to a tripped position resting on gate 66. Front and side seal members 52 and 55 remain in engagement with the gate during its outward movement but the frictional drag is reduced over that observed in U.S. Pat. No. 3,877,392. However pressure from air and lading urges legs 52*d* and 55*d* into closer engagement with the gate and thus loss of lading is reduced or avoided. Vertical leg 83 of pinion shaft guide 82 provides a stop for the gate when it assumes the full open position shown in FIG. 11. The front 66*a* of the gate remains in contact with seal 52 in the fully open position to prevent lading from exiting from the front wall of the outlet during unloading.

To close the gate, pinion shaft 72 is rotated in the opposite direction and the pinion shaft and gate move from right to left. Gate front 66a engages inclined portion 57 of ledge 56 midway in moving toward the closed position, and the gate is ramped up a small amount. While the gate engages seals 52 and 55 in moving toward the closed position, the frictional drag is not great. When the gate is nearly closed, gate front 66a engages ramp 60 and the gate moves up cam surface 62 to the horizontal surface 64. Door bearings 68 and 69 move upwardly relative to pinion shaft 72 because of elongated slots 70 provided in each door bearing. Inclined surface 98 of locking member 94 engages lug 100, and then rides up over locking lug 100 and then drops into the closed position. In the closed position door bearings 68 and 69 engage inclined portion 51a of Z members 51.

In the event the gate is inadvertently left open after unloading, the gate will close automatically when the car is impacted in the yard. The frictional drag of seal members 52 and 55 is less throughout most of the gate travel toward open position. Thus there is sufficient momentum for the gate to move up inclined portion 62 of ramp 60 and for locking member 94 to ride up over lug 100 into the closed position. Since seal members 52 and 55 and ramp surface 62 are inclined inwardly and downwardly there is little or no lading build up on the sides, front or back of of the outlet. Thus the gate assumes a properly closed position.

Thus an improved outlet is obtained.

What is claimed is:

1. A hopper outlet comprising:

inner and outer outlet end walls joining opposite ends of transversely spaced outlet side walls; at least one fixed rack located adjacent said outer outlet end wall and extending longitudinally away from the outlet; at least one door bearing attached to a generally horizontally movable outlet gate movable below said outer outlet end wall to open position; ramp means including an inclined cam surface located below said inner outlet end wall which support said gate in closed position; a transversely extending pinion shaft movable generally in a horizontal plane between open and closed positions of said gate and including at least one pinion which rides upon said rack during movement of said gate, said pinion shaft extending through a door bearing slot in said door bearing; said door bearing slot being elongated vertically to allow vertical movement of the door bearing relative to the pinion shaft as the gate is ramped in its movement between closed and open positions, downwardly into open position and upwardly into closed position.

2. A hopper outlet comprising:

inner and outer outlet end walls joining opposite ends of transversely spaced outlet side walls; at least one fixed rack located adjacent said outer outlet end wall and extending longitudinally away from the outlet; at least one door bearing attached to a generally horizontally movable outlet gate movable below said outer outlet end wall to open position; ramp means including an inclined cam surface located below said inner outlet end wall; elastomeric seals extending below said outlet side walls and said outlet outer wall; said seals being generally U-shaped and including an upper leg attached to an outlet support member and a lower leg which is inclined inwardly and downwardly and which is adapted to engage said gate; a transversely extending pinion shaft movable generally in a horizontal plane as said gate moves between open and closed position; said shaft including at least one pinion which rides upon said rack in moving between open and closed positions; said pinion shaft extending through a door bearing slot in said door bearing; said door bearing slot being elongated vertically to allow vertical movement of the door bearing relative to the pinion shaft as the gate is ramped in its movement between open and closed positions, downwardly into open position and upwardly into closed position; and whereby in moving between open and closed positions said gate engages lower legs depending from said outer outlet wall; and whereby in closed position lower legs depending from said side walls engage the gate.

3. A hopper outlet according to claim 2 wherein a seal member is located on said inner outlet end wall which includes a lower leg which extends downwardly and outwardly relative to the gate.

4. A hopper outlet according to claim 3 wherein said seal includes an upper leg which is attached to an inner outlet support member.

5. A hopper outlet according to claim 2 wherein said outlet includes a locking member which automatically assumes the locked position in the event the gate is left in the open position.

6. A hopper outlet according to claim 5 wherein said locking member is attached to a transversely extending locking shaft.

* * * * *